United States Patent [19]

Gurries

[11] 4,402,629

[45] Sep. 6, 1983

[54] RESONANTLY DRIVEN PAVEMENT CRUSHER

[75] Inventor: Raymond A. Gurries, Reno, Nev.

[73] Assignee: Resonant Technology Company, Sparks, Nev.

[21] Appl. No.: 329,149

[22] Filed: Dec. 10, 1981

Related U.S. Application Data

[63] Continuation-in-part of Ser. No. 157,138, Jun. 5, 1980, Pat. No. 4,340,255.

[51] Int. Cl.[3] ..... E01C 23/12

[52] U.S. Cl. ..... 404/90; 299/37; 173/139

[58] Field of Search ..... 404/90, 91, 133; 37/DIG. 18; 299/37, 14; 173/139 X; 172/40

[56] References Cited

U.S. PATENT DOCUMENTS

| | | | |
|---|---|---|---|
| Re. 25,401 | 6/1963 | Clynch | 404/133 X |
| 1,841,802 | 1/1932 | Gettelman | 299/37 |
| 2,029,363 | 2/1936 | Downie | 299/37 |
| 2,901,232 | 8/1959 | Lewis | 404/90 X |
| 3,133,730 | 5/1964 | Cornett | 404/90 X |
| 3,217,620 | 11/1965 | Mindrum | 404/133 X |
| 3,327,598 | 6/1967 | Wayer | 404/133 X |
| 3,907,450 | 9/1975 | Cutler | 404/90 |
| 4,230,369 | 10/1980 | Gurries | 299/37 X |
| 4,258,956 | 3/1981 | Gurries | 299/37 X |

*Primary Examiner*—Nile C. Byers, Jr.
*Attorney, Agent, or Firm*—Townsend and Townsend

[57] ABSTRACT

A pavement breaker including a mobile carrier vehicle is disclosed. A beam is provided having a resonant frequency with a pair of nodes spaced from the input and output ends of the beam and anti-nodes at each end and at the center. An oscillator is fixed to the input end of the beam to vibrate the beam at at least near its resonant frequency. The beam is mounted to the carrier vehicle at the node near the input end of the beam. A weight is superimposed over the beam at the node near the output end and has a bearing surface adapted to bear downwardly against the beam at that node. The weight is coupled to the vehicle to control the vertical position of the weight. A tool depends from the output end of the beam, and strikes the surface on which the vehicle rests at the vibration frequency of the beam as the tool vibrates responsively to vibrations of the beam. The reaction force generated by the tool is substantially absorbed by the weight and not transmitted to the carrier vehicle. The tool is provided with three segments, a middle segment which lies substantially horizontally while the beam is stationary, and forward and rear segments which are inclined upward. The forward section allows the tool to follow the ground, while the orientation of the real tool enhances the breaking action of the tool.

24 Claims, 10 Drawing Figures

RESONANTLY DRIVEN PAVEMENT CRUSHER

This application is a continuation-in-part of my copending application entitled RESONANTLY DRIVEN VERTICAL IMPACT SYSTEM, Ser. No. 157,138, filed June 5, 1980 now U.S. Pat. No. 4,340,255.

BACKGROUND OF THE INVENTION

The present invention relates to a vertical impact system, and in particular to a resonantly driven system for breaking up a pavement surface using a specially adapted pavement breaking tool.

A variety of different pavement breaking and other types of surface impact tools are in use at the present time. Typically, such tools employ a heavy weight which is lifted and allowed to fall to provide the power stroke of the tool. Lifting of the weight for each stroke is generally inefficient, but more efficient solutions have not been available to date where large forces are necessary. Pneumatic and hydraulic tools are often used, but such tools are limited as to the amount of force that can be applied because the reaction forces on the tool are equal to those applied to the surface.

In the patent literature, the patent to Gettelman, U.S. Pat. No. 1,841,802, discloses a pick or tamping tool located at the end of a leaf spring supported at its center. This flexible spring, however, is insufficient to generate sufficiently large forces to break up most pavement, or provide a sufficient tamping action. Also, the large amplitudes involved render the device hard to control, and applicant has no knowledge that the Gettelman device has ever been successfully applied in practice.

Theoretical advantages in using resonant systems to apply large forces have been disclosed in the patent literature, as illustrated in U.S. Pat. Nos. 3,232,669 and 3,367,716, to Bodine. However, such resonant techniques apparently have not been successfully applied to vertical impact tools such as the type disclosed herein.

SUMMARY OF THE INVENTION

The present invention provides a surface impact system including a pavement breaking tool particularly adapted to function with a resonant drive system. A resonant beam having anti-nodes at each end and one or more nodes therebetween is supported at said node(s) on a mobile carrier vehicle. An oscillator is fixed to an input anti-node of the beam to vibrate the beam at at least near its resonant frequency. The pavement breaking tool is rigidly attached to the output anti-node of the beam, located at one end thereof. The tool includes a substantially flat surface oriented parallel to the beam and lying substantially in the horizontal plane. An upwardly-inclined flange projects forward (with respect to the direction of travel) of the horizontal surface and is contiguous thereto. The preferred angle of inclination depends on the angle of motion of the tool relative to the ground, as will be described thoroughly hereinafter. The width of the tool may vary depending on the desired width of the swath to be cut.

As it is reciprocated by the beam, the tool moves at an angle relative to the pavement determined by its location relative to the forward node of the beam, the forward node acting as a center of rotation. The tool is located both forward and downward with respect to the node, and as the forward distance increases relative to the downward distance, the angle of motion approaches vertical. Typically, the tool strikes the pavement at an angle in the range from about 30° to 60° relative to the plane of the work face, more usually in the range from 35° to 55°.

Since the forward flange is also inclined relative to the plane of the work face (typically horizontal), as the tool is reciprocated the forward flange strikes the ground at a "closing angle" which depends on both the angle of inclination of the flange and on the angle of motion of the tool. Selection of a closing angle in the range from 6° to 18°, preferably from 8° to 16°, assures that the tool will break off the edge of the pavement, resulting in a far more efficient fracturing of the pavement. Moreover, it has been found that the horizontal surface also aids in crushing the broken fragments of pavement or concrete and moving them away from the area where breaking is taking place. Such combination of high breaking force and ability to clear the work area leads to a highly efficient pavement breaking system.

The closing angle is defined as the difference between the angle of motion of the tool and the angle of inclination of the flange. With both angles measured from horizontal, the angle of motion will always be greater than the angle of inclination so that the flange impacts the pavement on the downstroke. The amount greater (i.e., the size of the closing angle) is selected to maximize the breaking action of the tool.

Typically, the beam is mounted to the carrier vehicle at a node near the input end of the beam. A weight is superimposed over the beam at a node near the output end, and has a bearing surface adapted to bear downwardly against the beam at that node. The weight is coupled to the vehicle to control the vertical position of the weight. A tool depends from the output end of the beam, and strikes the surface on which the vehicle rests at the vibration frequency of the beam as the tool vibrates responsively to vibrations of the beam. The reaction force generated by the tool is substantially absorbed by the weight and not transmitted to the carrier vehicle.

In theory, resonant systems are supported at their nodes so that the input oscillatory forces are not transmitted to the supporting frame. However, the impact forces of the tool attached to the resonant system causes a reaction force which, at the resonant frequencies employed, is substantially constant. In typical past systems, the reaction force is transmitted directly to the supporting frame. The transmission of such a force to the frame is unacceptable for the relatively large forces generated by a surface impact tool such as that disclosed herein. However, the weight provided in the system of the present invention substantially absorbs the reaction force so that it is not transmitted to the frame. Preferably, the weight is supported by a single acting cylinder to further isolate reaction forces from the carrier vehicle.

In the present invention, it is preferred that the weight be significantly less than the input forces of the oscillator. Accordingly, if the tool encounters an obstacle which it is unable to penetrate, the weight will be lifted, moving the forward node position upwardly and allowing the system to continue to vibrate in a resonant mode. This flexibility avoids a forced vibration mode resulting in transmission of the oscillator forces directly to the frame with potential catastrophic consequences. In the preferred embodiment of the present invention, the oscillator motor is mounted on a frame which pivots along with the beam to preserve proper alignment.

Typically, the tool will include a second flange similar to the first but attached to the opposite side of the horizontal surface. The second flange, which lies at the rear of the tool as the vehicle is driven forward, does not contribute to the breaking action. Rather, it is provided so that the mounting of the tool may be reversed to extend its useful life.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
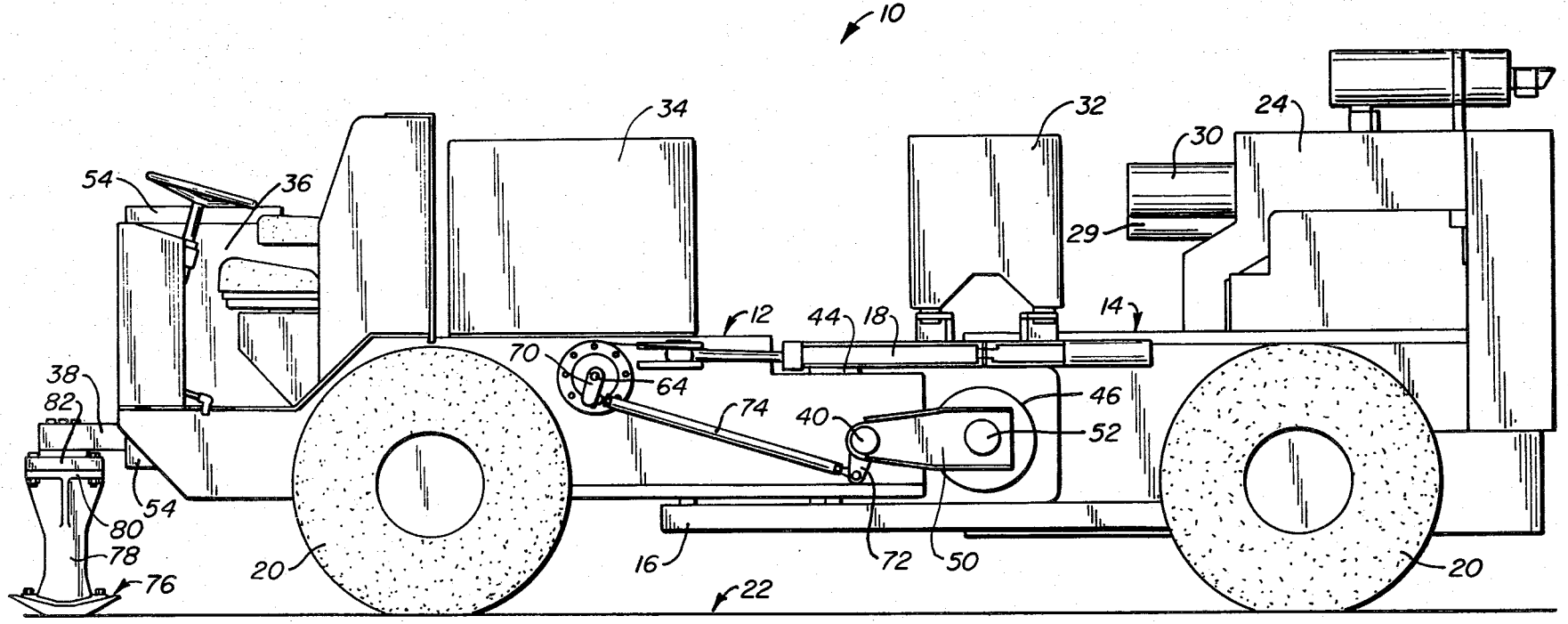
FIG. 1 is an elevation view of a preferred embodiment of the vertical impact system of the present invention.
Figure 2:
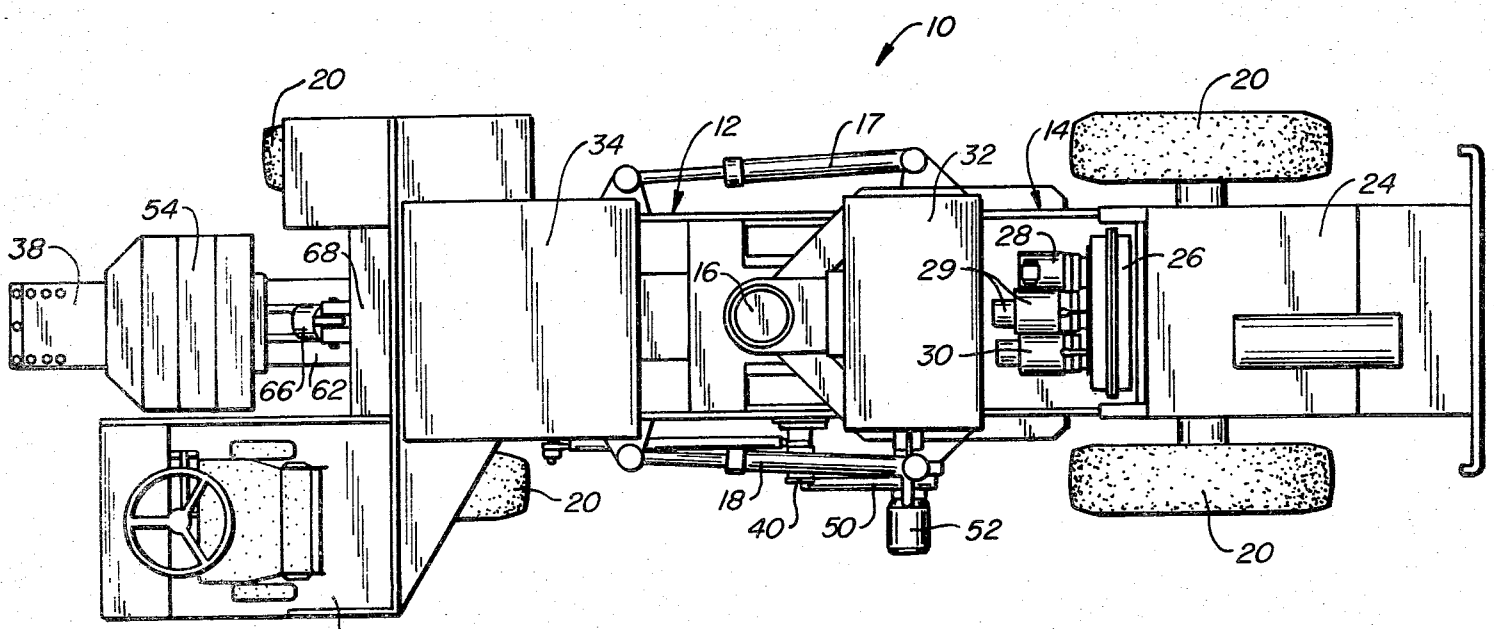
FIG. 2 is a plan view of the embodiment of FIG. 1.

The preferred embodiment 10 of the present invention is illustrated generally by way of reference to FIGS. 1 and 2 in combination. Impact system 10 includes a carrier vehicle with a forward frame 12 connected to a rear frame 14 by an articulating joint 16 (FIG. 2). Hydraulic actuators 17, 18 extend between forward and rear frames 12, 14 to control articulation of the vehicle. The carrier vehicle rides on wheels 20 over a paved surface 22 comprised of concrete, asphalt, cement or the like. The vertical impact forces applied by the impact system 10 are intended to break up the pavement, typically to facilitate its removal.

An engine 24 is mounted on rear frame 14. Engine 24 drives a hydraulic output 26 (FIG. 2) operating three hydraulic pumps 28, 29, and 30. A reservior 32 for hydraulic fluid is provided adjacent pumps 28–30. One of the pumps 28–30 drives wheels 20 to propel the vehicle, one of the pumps is used to control the vehicle and operate its articulating cylinders 17, 18 and other control systems, and the third pump operates an eccentric weight oscillator to be described hereinafter.

The forward portion 12 of the vehicle includes a large fuel tank 34 located remote from engine 24. The operator of the vehicle rides in a control cab 36 projecting forwardly and to one side of the remainder of the vehicle.

Figure 3:
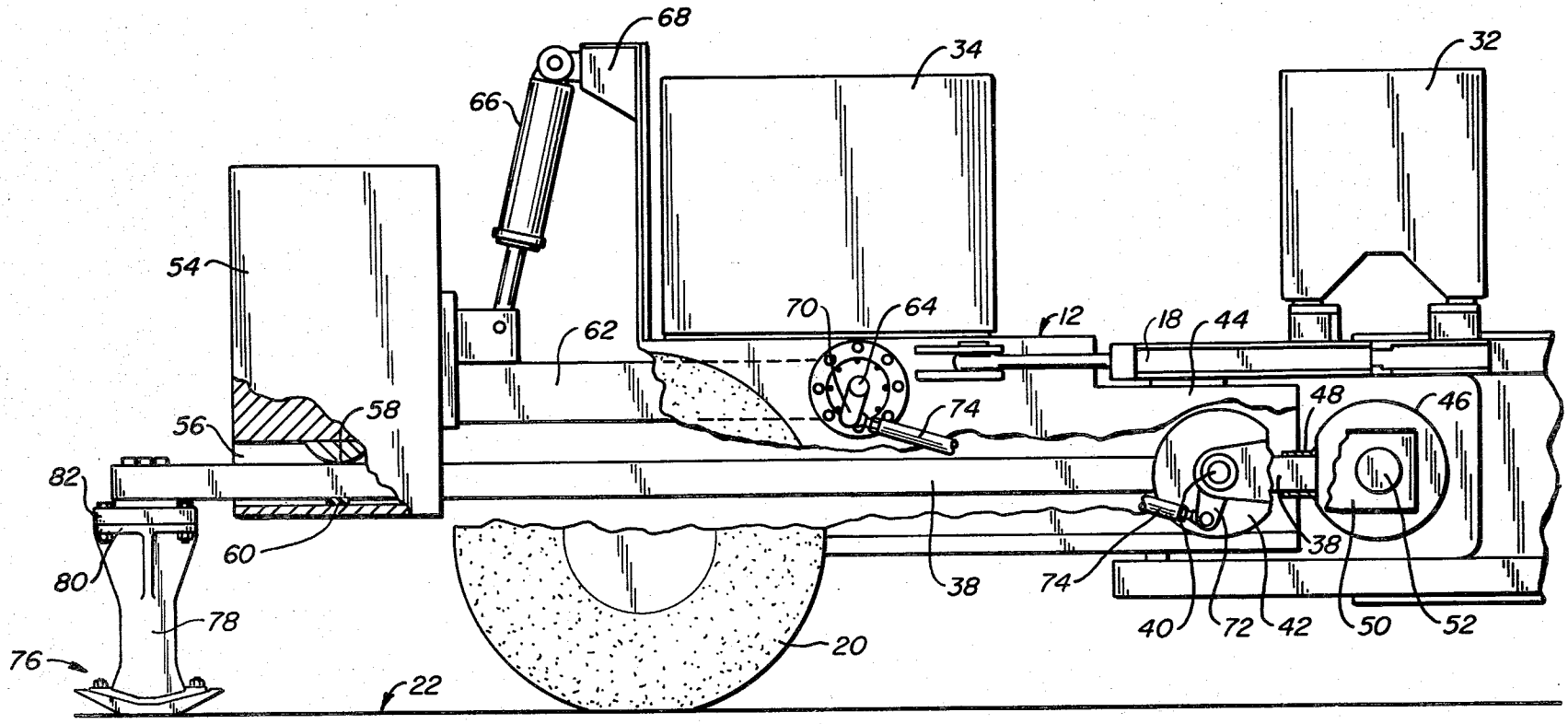
FIG. 3 is an elevation view of the embodiment of FIGS. 1 and 2 with portions broken away to illustrate the resonant system.

A solid, homogeneous resonant beam 38, typically steel, is supported by the carrier vehicle, as depicted in more detail by way of reference to FIG. 3. Beam 38 has a resonant frequency with forward and aft nodes spaced inwardly from its ends, and anti-nodes (locations of maximum amplitude) at its opposite ends and approximately at its center.

Resonant beam 38 is supported at its aft node by a shaft 40 penetrating the beam transversely at the location of the aft node. Shaft 40 is fixed to beam 38 and thus rotates with the beam. Shaft 40 is supported by resilient members such as 42 on opposite sides of the beam to isolate vibrations of the beam at the node from the surrounding frame. Resilient supports 42 are mounted on an extension 44 from forward frame 12 of the carrier vehicle which projects rearwardly beyond articulating joint 16.

Eccentric weight oscillator 46 (FIGS. 1 and 3) is attached to the aft end of beam 38 by plates 48. A motor mount 50 is rotatably mounted to shaft 40, and projects rearwardly to a position to the side of oscillator 46. A hydraulic motor 52, powered by one of the pumps 28–30 is supported by motor mount 50, and drives eccentric oscillator 46 to apply eccentric forces to resonant beam 38.

Typically, motor 52 drives oscillator 46 at a frequency slightly below the resonant frequency of the beam. As eccentric weight oscillator 46 rotates, it applies a force to beam 38 which moves in a rotational fashion about the axis of the oscillator. The components of force applied axially to beam 38 are absorbed by the weight of the beam. Components of force normal to the axis of beam 38 cause the aft end of the beam to vibrate in an up and down motion, inducing a near resonant vibration of the entire beam about its node locations.

A massive weight 54 is superimposed over beam 38 towards its forward end. An aperture 56 is provided in the weight through which beam 38 passes. Weight 54 includes a bearing surface 58 bearing downwardly on the beam at its forward node location. The weight of the beam is supported by a transverse resilient strip 60 on the bottom surface of aperture 56.

Weight 54 is mounted on a pivot arm 62 pivotably mounted to forward frame 12 on shaft 64. Shaft 64 is fixed to arm 62 and rotates therewith. The vertical position of weight 54 is controlled by a single acting hydraulic cylinder 66 (FIGS. 2 and 3) suspended from support 68 projecting upwardly from forward frame 12. Hydraulic cylinder 66 is single acting in that it is capable of supporting weight 54, but incapable of transmitting forces from the weight to support 68.

A bell crank arm 70 (FIGS. 1 and 3) is nonrotatably mounted to shaft 64 supporting pivot arm 62. A similar bell crank arm 72 is nonrotatably mounted to motor mount 50. A rod 74 interconnects bell crank arms 70 and 72 so that the rotational positions of motor mount 50 and shaft 64 coupled to the forward node of the beam by weight 54 are interdependent. As a result, vertical movement of the forward node of resonant beam 38 is transmitted through arm 74 to rotate motor mount 50 to maintain motor 52 aligned with the axis of oscillator 46.

A tool 76 is supported on a shank 78 terminating in a flange 80. Flange 80 is bolted to a corresponding flange 82 depending from the underside of the forward end of resonant beam 38. At the neutral or rest position of tool 76, it is slightly above surface 22.

Figure 4:
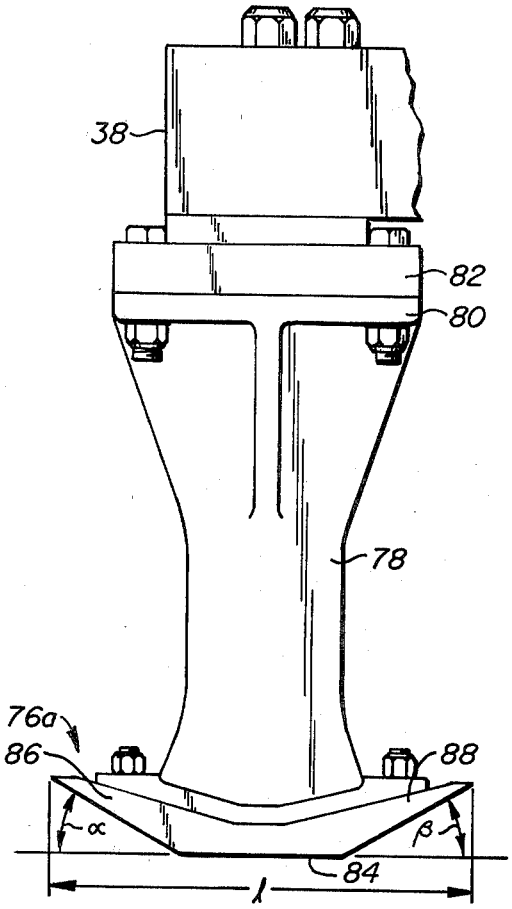
FIG. 4 is a side elevation view of a first embodiment of the work tool of the present invention.
Figure 5:
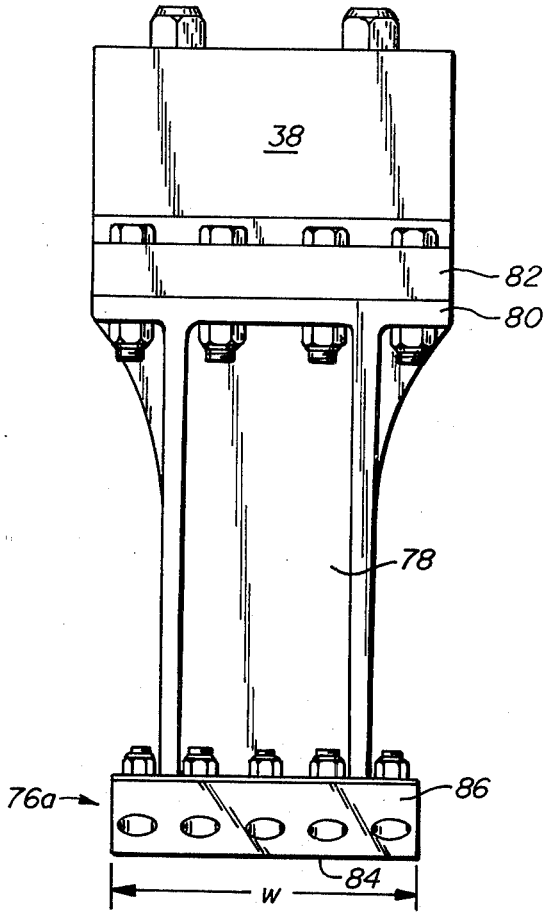
FIG. 5 is a front elevation view of the first embodiment of the work tool illustrated in FIG. 4.

The tool 76 of the present invention is specially adapted for breaking pavement, such as cement, concrete, asphalt and the like, to facilitate pavement removal in a variety of circumstances. Referring now particularly to FIGS. 4 and 5, the specific structure of a first embodiment 76*a* of the pavement breaking tool 76 will be described in detail. The tool 76*a* is typically bolted to the lower end of the shank 78 and comprises a plate having a central section 84 which lies substantially parallel to the ground 22 (FIGS. 1 and 3) when the resonant beam 38 is at rest, a forward flanged portion 86 inclined generally upward from the central section 84 and a rear flanged portion 88 also inclined generally upward from the central section 84. The forward flanged portion 86 is inclined upward at an angle $\alpha$ relative to the horizontal, where $\alpha$ lines in the range from approximately 25° to 35°, with a presently preferred orientation of approximately 30°. Typically, the rear flanged portion 86 will be inclined upward at an angle $\beta$ which is equal to $\alpha$. The angle $\beta$ does not have to equal $\alpha$ and, in fact, the rear portion of the tool 76*a* need not be inclined upward at all. A rear flange 88 is provided only so that the tool 76*a* may be reversed as the forward flange 86 suffers wear.

While the dimensions of the tool 76*a* may vary within relatively wide limits, the contact area between the lower surfaces of the tool, particularly the horizontal surface 84 and the forward flanged surface 86, should be large enough to break a substantial swath in the concrete so that the job may be completed in a reasonable time yet not so large that the applied force per unit area is reduced beyond that necessary to break the pavement. A tool having an overall length l (FIG. 4) of approximately 16" and a width w (FIG. 5) of approximately 12" has been found successful with a constant input force of approximately 10,000 pounds.

Figure 6:
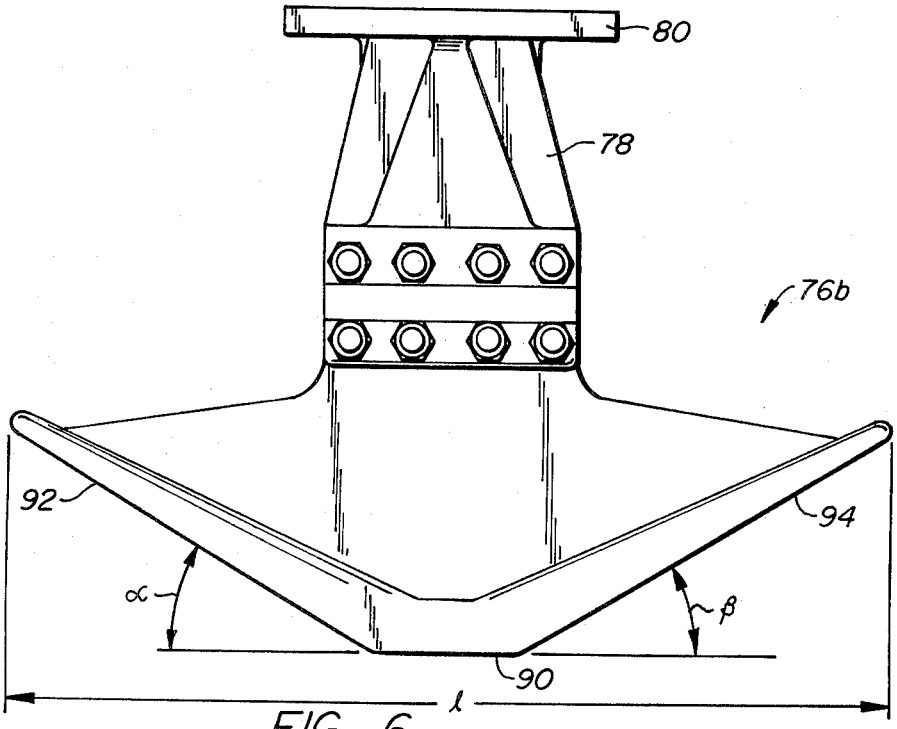
FIG. 6 is a side elevation view of a second embodiment of the work tool of the present invention.
Figure 7:
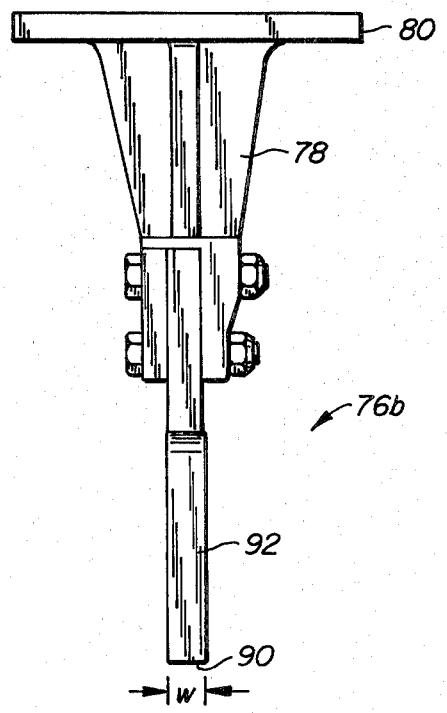
FIG. 7 is a front elevation view of the second embodiment of the work tool illustrated in FIG. 6.

FIGS. 6 and 7 illustrate an alternate embodiment 76*b* of the tool 76 specially adapted for cutting pavement, concrete and the like along a relatively narrow line. As in the first embodiment (FIGS. 4 and 5), the cutting tool 76*b* is bolted to the lower end of the shank 78 and comprises a central section 90, a forward flange 92 inclined upward at an angle $\alpha$ from the plate of the central section 90, and a rear section 94 inclined upward at an angle $\beta$ from the plane of the central section 90.

The width w (FIG. 7) of the cutting tool 76*b* will be substantially less than that of the breaking tool 76*a*. Otherwise, the dimensions may be similar. The overall length l (FIG. 6) may vary within wide limits, as can the relative lengths of the sections 90, 92 and 94. The angle $\alpha$ preferrably lies in the range from 20° to 35°, while the angle $\beta$ will normally be equal to $\alpha$ so that the tool 76*b* may be reversed.

Either embodiment 76*a* or 76*b* of the tool of the present invention would function in the absence of the rear flanged portion (88 and 94, respectively). It is desirable to provide the rear flange, however, so that the mounting of the tool may be reversed when the leading portion, i.e., the region between sections 84 and 86 or sections 90 and 92, becomes worn. In that case, the angle $\beta$ should equal $\alpha$ as selected for best performance.

A situation to be avoided in the operation of a resonant system is one in which downward movement of tool 76 relative to its neutral position is prevented, such as when system 10 encounters an upwardly inclined surface. If tool 76 cannot move downwardly from its neutral position, it essentially becomes locked in place, converting the forward end of beam 38 to a node and changing the vibrational characteristics of the beam. To prevent this situation from occurring, the size of weight 54 is significantly less than the input forces of oscillator 46. Accordingly, when tool 76 encounters such an obstacle, the reaction forces will overpower weight 54, causing the weight to lift, shifting the forward node location upwardly and allowing the resonant beam to continue to vibrate in its near resonant mode.

In operation, oscillator 46 supplies forces to resonant beam 38 to cause the resonant beam to vibrate at least near its resonant frequency. At that frequency, the beam exhibits two nodes, an aft node at the location of support shaft 40, and a forward node underlying bearing surface 58 of weight 54. Tool 76 vibrates vertically about its neutral position, and strikes the underlying surface 22 on its downward stroke to perform the desired function.

In viewing FIG. 3 it is evident that resonant beam 38 is supported only at two positions, namely, at its aft node on shaft 40 and at its forward node by weight 54. Since the node locations are basically stationary when the beam is operating in its near resonant mode, the fact that the beam is vibrating does not cause significant vibrational forces to be transmitted from the beam to the supporting vehicle.

The impact of tool 76 on underlying surface 22 results in the application of an upwardly directed reaction force on beam 38. These reaction forces are transmitted almost entirely to weight 54 by way of bearing surface 58. These reaction forces are substantially absorbed by the weight, and are not transmitted to the frame through single acting cylinder 66. As a result, operation of the resonant system is substantially isolated from the carrier vehicle, and large impact forces can be exerted on surface 22 without corresponding reaction forces being exerted on the carrier vehicle.

Figure 8:
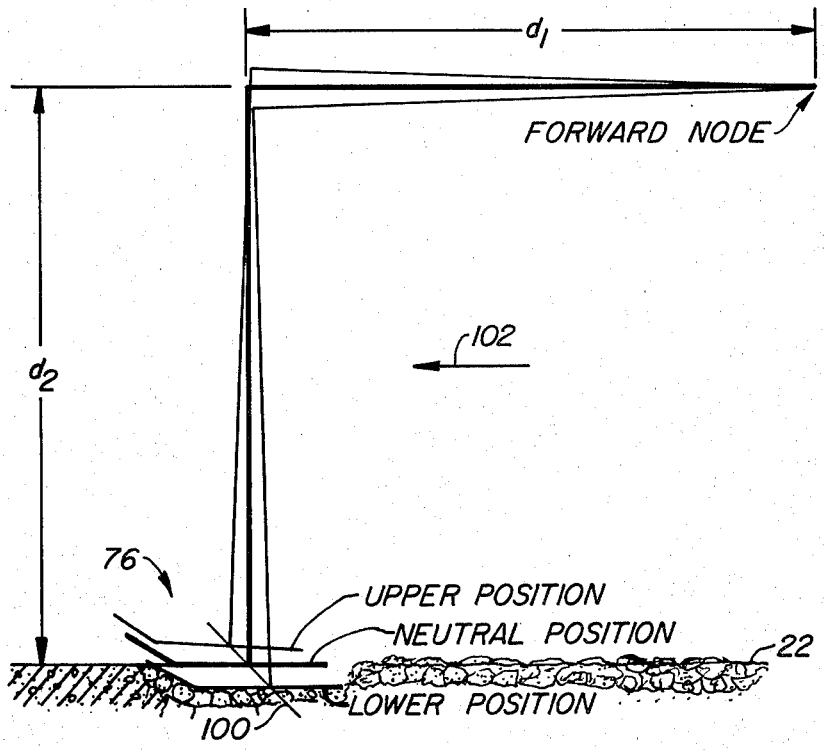
FIG. 8 is a schematic view illustrating the work tool in motion.
Figure 9A:
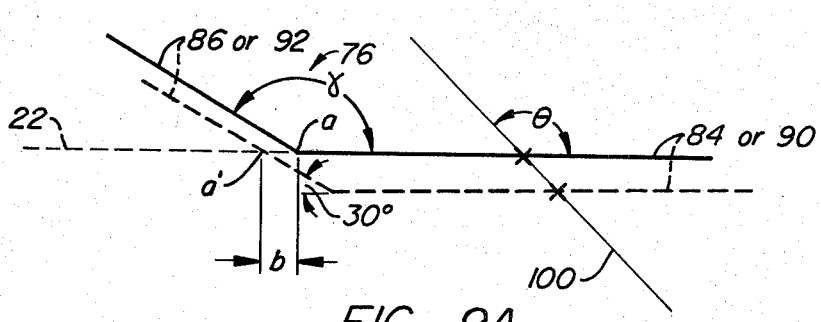
FIGS. 9A and 9B are schematic views which illustrate the effect of varying the inclination of the flanged surface of the tool.
Figure 9B:
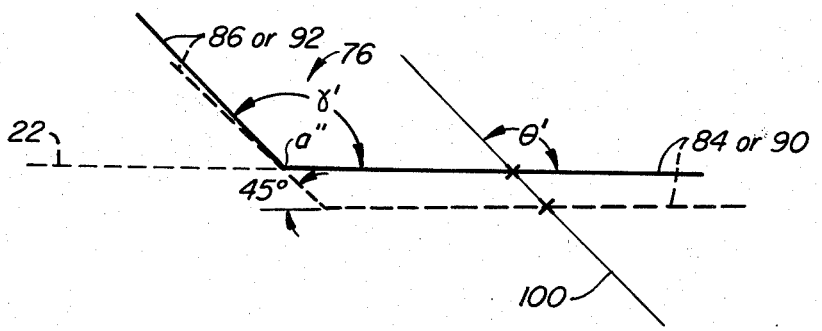

The operation of the tool 76 (including both embodiments 76*a* and 76*b*) in breaking or cutting pavement may be understood by reference to FIGS. 8, 9A and 9B. As explained above, the tool 76 reciprocates about a neutral position which corresponds to the position of the tool when the resonant beam 38 is stationary. The motion of the tool 76, however, is not truly vertical and depends on the length of the portion of the resonant beam 38 forward of the forward node, shown generally as distance $d_1$ on FIG. 8, relative to the length of the tool sleeve 78 shown generally as distance $d_2$. Typically, the lengths $d_1$ and $d_2$ be substantially equal so that the motion of the tool 76 will describe an arc having an angle of motion, indicated by tangent 100 at the neutral position, lying at approximately 45° to the plane of the work face which is typically horizontal. The angle of motion may vary, however, as $d_1$ and $d_2$ are adjusted for particular applications. The resulting angle of motion may vary widely, typically within the range from 20° to 70°, more usually between 30° to 60°, relative to the plane of the work face without degrading the performance of the system, so long as the proper closing angle is maintained, as discussed hereinafter.

Selection of the value of the angle $\alpha$ (FIGS. 4 and 6) formed by the forward section (86 or 92) is important to the proper operation of the tool 76. If the forward section were not flanged (i.e., $\alpha=0°$), the force per unit area imparted by the tool to the pavement would be greatly reduced, reducing the ability of the tool to break the pavement. As $\alpha$ increases, the forward flange applies force over a much smaller area and the pavement is more easily broken. As the orientation of the forward flange approaches the angle of motion of the tool, however, the surface of the flange becomes nearly parallel with the direction in which it is moving and the flange is unable to break the pavement.

Referring now to FIGS. 9A and 9B, the closing angle is defined as $(\gamma-\theta)$, which is the difference between the angle of motion $(\theta)$ of the tool and the angle of inclination $(\gamma)$ of the flange. As stated hereinbefore, so long as $(\gamma-\theta)$ lies in the range between 6° and 18°, preferably from 8° to 16°, more preferably at approximately 12°, operation of the pavement breaker will be successful. The reasons for such successful operation will now be set forth.

The action of the forward flange (86 or 92) is best understood in reference to FIGS. 9A and 9B. In FIG. 9A, the forward flange (86 or 92) is inclined upward at $\gamma$ from the central section (84 or 90). The junction between the flange and the central portion of the tool 76 strikes the pavement 22, on the downstroke, at point a. Since the angle of motion $\theta$ of the tool 76 is less than $\gamma$ (by 15° as illustrated), as the tool continues its downward movement, contact between the flange and the pavement moves forward to point a'. Thus, an incremental portion b of pavement will be broken by each downstroke. It should be noted that the distance between a and a' results only in small part from the forward movement of the vehicle 10. Rather, the distance depends on the relative inclinations of the surface of the flange and the tangential direction of motion of the tool 76.

As the orientation of the forward flange (86 or 92) approaches the angle of motion (i.e., $\theta'\cong\gamma'$), the situation approaches that illustrated in FIG. 9B. There, the contact point a'' between the flange and the pavement remains virtually stationary as the tool is driven downward. Thus, no breaking at all occurs. In that event, the leading edge of the central portion (84 or 90) of the tool 76 will encounter unbroken pavement as the vehicle 10 is driven forward. Since the force per unit area applied by the central portion is so low, the central portion will be unable to break the pavement and the tool will not function.

With the breaking tool 76*a*, by driving the vehicle forward at a relatively slow speed in the range from 0.5 to 1 foot per second, the pavement is typically broken into very small chunks which can easily be reused in making concrete and other composite materials. It is possible, however, to drive the vehicle at a much higher rate, in the range from 1 to 3 feet per second when it is desired to complete the job rapidly. The broken pieces resulting from the latter method of operation are much larger and must be broken down further prior to reuse.

It has also been found that with the breaking tool 76*a* of the present invention, the pavement may be broken by running the machine over parallel, spaced-apart strips with substantial fracturing occurring in the areas between said strips without the direct application of force.

With the cutting tool 76*b*, the vehicle may be driven at a rapid rate, typically in excess of 1 foot per second, without any deterioration in the cut achieved.

While a preferred embodiment of the present invention is illustrated in detail, it is appartent that modifications and adaptations of that embodiment will occur to those skilled in the art. However, it is to be expressly understood that such modifications and adaptations are within the spirit and scope of the present invention, as set forth in the following claims.

What is claimed is:

1. A pavement breaker comprising:

a mobile carrier vehicle;

a beam having a resonant frequency with a pair of nodes spaced from the ends of the beam and anti-nodes at each end comprising input and output ends respectively and at the center of the beam;

an oscillator fixed to the input end of the beam to vibrate the beam at at least near its resonant frequency;

means for mounting the beam to the carrier vehicle substantially at the node near the input end of the beam;

a weight superimposed over the beam at the node near the output end and having a bearing surface adapted to bear downwardly against the beam at said node;

means for coupling the weight to the vehicle to control the vertical position of the weight; and a tool depending from the output end of the beam so that the vibration of the beam causes the tool to travel along an angle of motion oblique to the horizontal, said tool having a first surface lying in a plane substantially parallel to that of the beam and a forwardly directed flanged surface contiguous with the first surface, said flanged surface being inclined at an angle from approximately 6° to 18° closer to horizontal than the angle of motion.

2. The breaker of claim 1, wherein the angle of motion lies in the range from 20° to 70° and the angle of inclination of the flange lies in the range from 2° to 64° with respect to horizontal.

3. The breaker of claim 1, wherein the tool further comprises a second flanged surface continuous with the first surface, said second flanged surface being inclined upward in the direction away from the input end of the beam.

4. The breaker of claim 3, wherein the first and second flanged surface are inclined at the same angle relative to the first surface.

5. The breaker of claim 1 wherein the weight includes a support member underlying the beam to support the weight of the beam at the node near the output end.

6. The breaker of claim 1 wherein the coupling means comprises means for suspending said weight without transferring upward forces from the weight to the vehicle caused by reaction forces resulting from the tool striking the surface.

7. The breaker of claim 1 wherein the size of the weight is significantly less than the forces exerted by the oscillator on the beam so that the weight moves upwardly when the tool encounters an obstacle and prevents the beam from entering a forced vibration mode.

8. The breaker of claim 1 wherein the beam comprises a solid, homogeneous metal member.

9. The system of claim 1 or 6 wherein the beam mounting means includes a motor mount mounted to the vehicle along the axis of the node near the input end of the beam and extending to a position proximate the axis of the oscillator, and wherein the oscillator includes a drive motor fixed to said motor mount.

10. A surface impact system comprising:

a mobile carrier vehicle;

a solid beam having a resonant frequency with a pair of nodes spaced from the ends of the beam and anti-nodes at each end comprising input and output ends respectively and at the center of the beam;

an oscillator fixed to the input end of the beam to vibrate the beam at at least near its resonant frequency;

means for mounting the beam to the carrier vehicle substantially at the node near the input end of the beam so that the beam is pivotable with respect to the carrier about a horizontal axis passing through said node;

a weight superimposed over the beam at the node near the output end and having a bearing surface adapted to bear downwardly against the beam at said node and a support surface to support the weight of the beam, the size of said weight being significantly less than the input forces of the oscillator to allow the oscillator to move the weight;

means for suspending the weight from the vehicle to control the vertical position of the weight, said suspending means supporting the said weight without transferring upward forces from the weight to the vehicle; and a tool depending from the output end of the beam and adapted to strike the surface underlying the vehicle at the vibration frequency of the beam as the tool vibrates responsively to vibrations of the beam and at an angle of motion determined by the geometry of mounting, generating a reaction force which is substantially absorbed by the weight and not transmitted to the vehicle, said tool including a flat surface lying substantially parallel to the plane of the beam and a surface inclined upwardly from the flat surface at an angle closer to horizontal than the angle of motion by from about 6° to 18°.

11. The system of claim 6 or 10 wherein the suspending means comprises a single acting cylinder capable of supporting the weight but incapable of transmitting upward forces from the weight to the vehicle.

12. The system of claim 1 or 10 wherein the vehicle has an articulated frame, and the beam is supported by the forward portion of the articulated frame.

13. The system of claim 1 or 10 wherein the oscillator comprises an eccentric weight oscillator.

14. The system of claim 10, wherein the angle between the inclined surface and the angle of motion lies in the range from 8° to 16°.

15. The system of claim 10, wherein the angle between the inclined surface and the angle of motion is 12°.

16. The system of claim 10, wherein the tool further includes a second upwardly inclined surface extending in a direction away from the input end of the beam.

17. The system of claim 11 wherein the motor mount is operatively coupled to the weight so that the motor mount pivots responsively to movement of the weight.

18. The system of claim 12 wherein the coupling means includes a pivot arm attached to the weight and allowing vertical movement of the weight relative to the vehicle, and wherein the pivot arm is operatively coupled to the motor mount.

19. In a pavement breaker including a mobile frame; a resonant beam having an input coincident with an anti-node located at one end of the beam and an output coincident with an anti-node located at the other end of the beam, the beam being supported on the frame at one or more nodes located intermediate the ends of the beam; and a means fixed to the input of the beam for vibrating the beam at at least near its resonant frequency; an improved pavement breaking tool secured to the output of the beam so that said tool is reciprocated by the beam along a line of travel to periodically strike a work face, said improved tool comprising a first surface and a second surface joined along a common edge, wherein said first surface lies substantially parallel to the beam and the second surface is inclined forwardly upward from the first surface so that the second surface impacts the pavement at an angle which lies near, but closer to the plane of the work face than, the line of travel of the tool.

20. An improved pavement breaking tool as in claim 19, wherein the second surface is inclined from 6° to 18° closer to the plane of the work face than the line of travel of the tool.

21. An improved pavement breaking tool as in claim 19, wherein the second surface is inclined upward from at from 27° to 39° and the line of travel of the tool is approximately 45° from the plane of the work face.

22. An improved pavement breaking tool as in claim 19, wherein the second surface is inclined upward at from 25° to 37° and the line of travel of the tool is approximately 45° from the plane of the work face.

23. An improved pavement breaking tool as in claim 19, wherein the second surface is inclined upward at approximately 33° and the line of travel is approximately 45° from the plane of the work face.

24. An improved pavement breaking tool as in claim 19, wherein the tool further comprises a third surface which is similar to the second surface and is disposed symmetrically to the second surface with respect to the first surface.

* * * * *